US005600874A

United States Patent [19]

Jungkind

[11] Patent Number: 5,600,874

[45] Date of Patent: Feb. 11, 1997

[54] CENTRAL CLOSURE FOR SHOES

[75] Inventor: Roland Jungkind, Garmisch-Partenkirchen, Germany

[73] Assignee: Puma AG Rudolf Dassler Sport, Germany

[21] Appl. No.: 481,515

[22] PCT Filed: Dec. 27, 1993

[86] PCT No.: PCT/DE93/01251

§ 371 Date: Jul. 25, 1995

§ 102(e) Date: Jul. 25, 1995

[87] PCT Pub. No.: WO94/17686

PCT Pub. Date: Aug. 18, 1994

[30] Foreign Application Priority Data

Feb. 8, 1993 [DE] Germany ..... 43 03 569.8

[51] Int. Cl.[6] ..... A43B 5/00; A43C 11/00

[52] U.S. Cl. ..... 24/68 SK; 24/70 SK; 24/71 SK; 36/50.1

[58] Field of Search ..... 24/68 SK, 69 SK, 24/70 SK, 71 SK, 590; 36/50.1, 119

[56] References Cited

U.S. PATENT DOCUMENTS

| | | | |
|---|---|---|---|
| 4,433,456 | 2/1984 | Baggio | 24/68 SK |
| 4,748,726 | 6/1988 | Schoch | 24/68 SK |
| 4,787,124 | 11/1988 | Pozzobon et al. | 24/68 SK |
| 4,841,649 | 6/1989 | Baggio et al. | 24/68 SK |
| 4,916,836 | 4/1990 | Baggio et al. | 36/119 |
| 5,042,177 | 8/1991 | Schoch | 36/50.1 |
| 5,152,038 | 10/1992 | Schoch | 24/68 SK |

FOREIGN PATENT DOCUMENTS

| | | |
|---|---|---|
| 0255869 | 2/1988 | European Pat. Off. . |
| 0393380 | 10/1990 | European Pat. Off. . |
| 4240916 | 10/1993 | Germany . |

*Primary Examiner*—Victor N. Sakran

*Attorney, Agent, or Firm*—Sixbey, Friedman, Leedom & Ferguson, P.C.; David S. Safran

[57] ABSTRACT

The object of the invention is to improve a central closing device for shoes with a rotationally supported cord disc for at least one cord-type tensioning member for closing the shoe in such a way that the number of rotations of the cord disci is limited without any increasing the space required. This object is achieved by the fact that both the cord disc (3) and a stationary member (1 or 41) each have mutually-cooperating tooth profiles (41*a*, 42*a* or 41*b*, 42*b*) having the same tooth pitch but of different diameters. Located in the intermediate space (49) created due to the different diameters of the tooth profiles (41*a*, 42*a* or 41*b*, 42*b*) is an idling pinion (43) of the same pitch, which meshes with the two tooth profiles (41*a*, 42*a* or 41*b*, 42*b*). At least one stop (46, 46') is provided to limit the travel of the idling pinion (43).

16 Claims, 1 Drawing Sheet

CENTRAL CLOSURE FOR SHOES

BACKGROUND OF THE INVENTION

This invention relates to a central closure for shoes with a rotatably mounted sheave for at least one rope-like tightening element for closing the shoe, in which the sheave is coupled to a gear by an actuating element and can be driven via the latter and the number of revolutions of the sheave can be limited by a stop.

Such a central closure, designed as a rotating closure, is known from EP-0 393 380 B1. The fact that the number of revolutions of the sheave is limited to somewhat less than two full revolutions is necessitated there by application of the pulley principle. In this case, one pulley is formed by the sheave. This has a carrier, which can stop after about one rotation on a rotatable arm, whereby said arm represents the towed sleeve target and can strike with a stop block against a housing edge. In this case, small structural dimensions are sought, even though a longer pull path to close the shoe is necessary.

In this known device, the diameter of the sheave must be selected in accordance with the rope path and the not quite two complete revolutions of the sheave that are possible there. In the case of long pull paths, therefore, the diameter of the sheave is also to be selected suitably large. In the case of this known device, therefore, freedom in the selection of the sizing of the dimensions of this device is greatly restricted.

On the other hand, the number of revolutions of the sheave could be increased by using additional pulleys, so that a longer pull path could be handled by increasing the number of turns on the sheave. This would, however, require a larger structural volume corresponding to the thickness of the additional pulleys.

SUMMARY OF THE INVENTION

With this invention the object is to be achieved, i.e., with a limitation on the number of revolutions of the sheave improving a central closure of the above-mentioned type in such a way that it is to be possible to increase the number of revolutions of the sheave to be limited without scaling-up the structural volume.

This object is achieved with the features of claim 1.

With the aid of the device for limiting the number of revolutions of the sheave based on the principle of a planetary gear, it is possible in a simple way, through the selection of the transmission ratio of the gear as well as the arrangement of stop(s), to select the number of revolutions of the sheave independently of outer dimensions within relatively broad limits, for example, at a ratio of between 2:1 to 10:1. Thus, by changing, for example, increasing the diameter of the toothing of the sheave and correspondingly changing, for example reducing the diameter of the freerunning gearwheel, a prescribed central closure with transmission ratios adapted to the respective application can be produced, with no other structural changes being necessary.

Below, the invention is described in more detail based on the embodiments illustrated in the drawing. Here:

FIG. 1 shows a side view of a central closure according to the invention in one section through the central axis (cross section), FIGS. 2 to 4 show one view each along section I—I of FIG. 1 in, in each case, another set position with a pinion gear, in which the toothing of the immovable part has the larger diameter and FIGS. 5 to 7 show one view each along section I—I of FIG. 1 in another set position, respectively, with a pinion gear, in which the toothing of the immovable part has the smaller diameter.

DETAILED DESCRIPTION OF THE PREFERRED EMBODIMENTS

Figure 1:
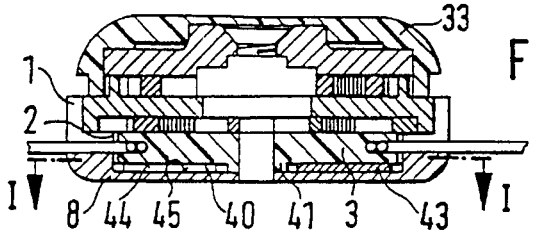

In FIG. 1, a central closure for shoes, especially for sport shoes, leisure shoes, or shoes for rehabilitation, is depicted from the side in cross section—i.e., in a section through the central axis, which has a housing part 1, designed as a flat housing shell, with a circular recess 2 to accommodate a sheave 3. Sheave 3 can be driven with a gear, which is provided between sheave 3 and a rotating element 33 that can be actuated from outside or by another actuating element, for example a lever or lever system.

Preferably a gear as described in prior patent DE 42 40 916 C1 of Dec. 4, 1992 (which corresponds to applicant's co-pending U.S. patent application Ser. No. 08/446,732) is used. This embodiment according to the invention is not limited, however, to the combination with this type of gear.

A flat, disk-shaped hollow 40, into which a shaft projection of sheave 3 that is designed as pinion 41 with toothing 41*a* projects, is provided between sheave 3 and bottom 8 of housing part 1. The vertical inside wall of the housing of hollow 40 is provided with round toothing 42*a* in the form of an internal ring gear 42. In gap 49 that is formed between pinion 41 and toothing 42*a* of internal ring gear 42, a gearwheel 43 that meshes with these two gear parts 41, 42 is arranged with the same modulus as two other gear parts 41, 42 and is guided in a freewheeling manner by bottom side 44 of sheave 3 and inside bottom surface 45 of bottom 8.

In hollow 40, a stop 46, for example a peg molded to bottom 8 or inserted into the latter, is provided at one point, which projects into the circular path on which gearwheel 43 rotates and whose freedom of motion is thus limited in two directions of rotation.

With these measures, the number of revolutions of sheave 3 is specified or can be calculated corresponding to the transmission ratio of the gear that is composed of pinion 41, internal ring gear 42 or toothing 42*a* and gearwheel 43, as well as the arrangement of stop 46, and thus can be adapted to the given requirements. Through the selection of the reference diameter of pinion 41 and gearwheel 43 and/or corresponding to the length of the circular path that is blocked by stop 46 for gearwheel 43, it is possible to determine the number of revolutions of sheave 3 or to adapt to specific requirements.

The reference diameter of pinion 41 or of gearwheel 43 corresponds to, respectively, the product of the modulus (measured, for example, in "mm") and the number of teeth.

The gear that is provided according to the invention in order to limit the number of revolutions of sheave 3 is basically a planetary gear, whereby pinion 41 forms the sun wheel and freewheeling gearwheel 43 forms the planet wheel.

Figure 2:
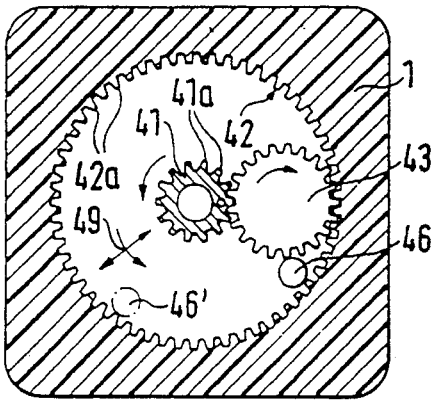

The way in which the arrangement for limiting the number of revolutions of sheave 3 according to the invention works is as follows:

If pinion 41 rotates counterclockwise from the setting depicted in FIG. 2, gearwheel 43 will be driven clockwise and will move counterclockwise on a circular path.

Figure 3:
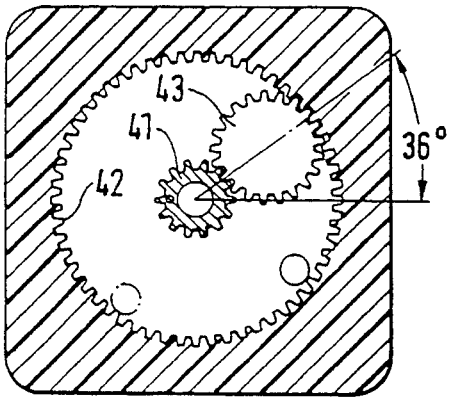

FIG. 3 shows the position of the gear after pinion 41 rotates by 180°. Corresponding to the number of teeth of 14 that are shown for pinion 41 and of 56 teeth of toothing 42*a* of internal ring gear 42 and the transmission ratio resulting from them:

$$\ddot{U} = 1 + \frac{\text{Number of teeth of the outside wheel}}{\text{Number of teeth of the inside wheel}}$$

in this case gearwheel 43 has moved an additional 36° from 5.

Figure 4:
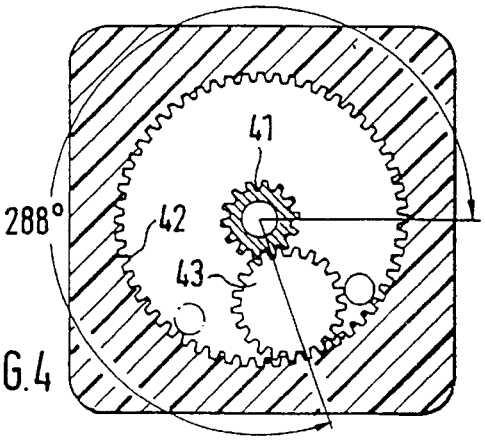

As pinion 41 continues to turn, after four complete revolutions, gearwheel 43 finally reaches stop 46, as depicted in FIG. 4. In this case, gearwheel 43 has moved another 288° on its circular path. As can easily be seen, the range of movement of gearwheel 43 can be limited still further in a simple way in that a second stop 46' is provided, as indicated by dotted lines in, for example, FIGS. 2 to 4. In this connection, several plug openings into which additional pegs 46' can be inserted depending on the desired limitation of the number of revolutions of sheave 3 can be present at various angle intervals from one another in bottom 8 of housing part 1. Instead of two stops 46, 46', only one stop may also be provided, which extends over a desired angular area to be blocked, or several such stops may be attached. In this way, a large range of variation of the possible rotational speed of sheave 3 can be set by the selection of stops 46, 46', etc. even without changing the dimensions of the gear that is composed of pinion 41, internal ring gear 42, and gearwheel 43.

Figure 5:
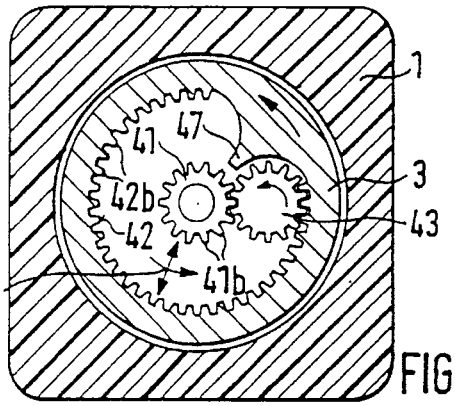
Figure 6:
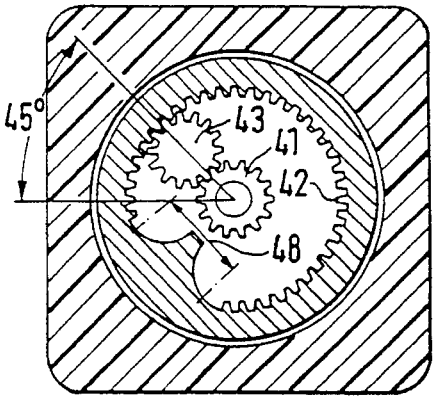
Figure 7:
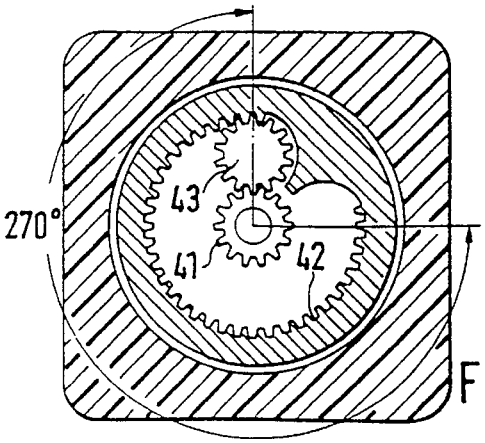

In the embodiment of a gear for limiting the number of revolutions of sheave 3 depicted in FIGS. 5 to 7, pinion 41 is arranged in a stationary manner by, for example, being a part of housing part 1 itself or being attached to the latter in such a way as to be unable to rotate. The driving of gearwheel 43 is done via toothing 42*b*, which is provided on sheave 3 in the form of an internal ring gear 42. In this case, however, toothing 42*b* is not completely finished, and non-serrated section 48 (FIG. 6) with an arm 47 that projects inward forms stop 46 to limit the path of gearwheel 43.

If, in this embodiment, sheave 3 is rotated counterclockwise via rotating element 33 according to FIG. 5, gearwheel 43 is also rotated counterclockwise, and at the same time pinion 41 also moves in the same direction around its circular path.

After sheave 3 rotates half-way, the arrangement shown in FIG. 6 is reached. In the case of the transmission ratio selected here $$\ddot{U} = 1 + \frac{\text{number of teeth of the outside wheel}}{\text{number of teeth of the inside wheel}}$$

of 4 by 42 teeth of toothing 42*b* and 14 teeth of pinion 41, the relative path of pinion 41 to sheave 3 is exactly 45° in this case, i.e., one rotation of sheave 3 corresponds to additional movement around the relative path by 90°.

After three complete revolutions of sheave 3, the end position depicted in FIG. 7 is reached. The size of section 48 corresponds here to the blocking of a complete rotation of sheave 3. The relative path of pinion 41 to sheave 3 reaches 270° here.

With the invention, the desired number of revolutions of sheave 3 can thus be set, for example, at two to ten revolutions without scaling up the structural volume of the central closure; this is made possible by installing or providing stops 46, 46' or the like and/or by changing the diameter of pinion 41 and toothing 42*a* or 42*b* of internal ting gear 42 when gearwheel 43 is appropriately adapted.

The two variant embodiments of the invention, as depicted in FIGS. 2 to 4, on the one hand, and in FIGS. 5 to 7, on the other, are characterized in that in each case at least one toothed groove of toothing 42*a* of the immovable part—housing part I—or of toothing 42*b* of the movable part—sheave 3—is closed or is not designed or in any case is not completely designed as toothed groove.

I claim:

1. Central closure for shoes with a rotatably mounted sheave for at least one ropelike tightening element for closing the shoe, in which the sheave is coupled to a gear by an actuating element and can be driven via the latter and the number of revolutions of the sheave can be limited by a stop, characterized in that both the sheave and an immovable part each comprise a toothing with the same tooth pitch that are effectively connected to one another, are arranged coaxially to one another, but have different diameters, in that a gap is created between the toothing of the sheave and the toothing of the immovable part by the different diameters thereof, a gearwheel that meshes with the two toothings is arranged in a freewheeling manner with the same tooth pitch is located in said gap, and in that at least one stop is located in said gap within a path of travel of the freewheeling gearwheel for limiting the travel thereof.

2. Central closure according to claim 1, wherein said at least one stop comprises at least one inserted part.

3. Central closure according to claim 2, wherein said at least one inserted part is a pin-shaped part.

4. Central closure according to claim 2, wherein said at least one inserted part is a part which extends of an angular range of the path of travel of the gearwheel.

5. Central closure according to claim 2, wherein the toothing of the sheave forms a structural unit thereof.

6. Central closure according to claim 5, wherein the sheave and the toothing thereof consist of a homogeneous part.

7. Central closure according to claim 1, wherein the toothing of one of the immovable part and the movable part is interrupted in at least one section because of stops (46, 46'), has an incompletely formed toothed groove corresponding to a portion of the path of travel of the gear wheel to which is movement of the gear wheel is prevented by said at least one stop.

8. Central closure according to claim 7, wherein said at least one stop is formed as an integral part of said sheave.

9. Central closure according to claim 3, wherein the toothing of the sheave forms a structural unit thereof.

10. Central closure according to claim 4, wherein the sheave and the toothing thereof consist of a homogeneous part.

11. Central closure according to claim 1, wherein, of the coaxially arranged toothings of the sheave and immovable part, the toothing of the immovable part has a larger diameter than the toothing of the sheave.

12. Central closure according to claim 1, wherein, of the coaxially arranged toothings of the sheave and immovable part, the toothing of the sheave has a larger diameter than toothing of the immovable part.

13. Central closure according to claim 1, wherein the toothing of the sheave forms a structural unit thereof.

14. Central closure according to claim 13, wherein the sheave and the toothing thereof consist of a homogeneous part.

15. Central closure according to claim 1, wherein the immovable part is formed by part of a housing of the closure.

16. Central closure according to claim 1, wherein the immovable part comprises a pinion gear.

* * * * *